US005490488A

United States Patent [19]

Aversa et al.

[11] Patent Number: 5,490,488

[45] Date of Patent: Feb. 13, 1996

[54] INTERNAL COMBUSTION ENGINE INTAKE MANIFOLD WITH INTEGRAL EGR COOLER AND PORTED EGR FLOW PASSAGES

[75] Inventors: Piero Aversa, Dearborn; David C. Ives, Canton; Hajnal Minger, Dearborn; William K. Ojala, Bingham Farms; Philip R. Zeiser, Dearborn, all of Mich.

[73] Assignee: Ford Motor Company, Dearborn, Mich.

[21] Appl. No.: 417,354

[22] Filed: Apr. 5, 1995

[51] Int. Cl.[6] ..... F02M 25/07

[52] U.S. Cl. ..... 123/570; 123/184.31

[58] Field of Search ..... 123/41.31, 184.21, 123/184.31, 184.32, 184.38, 184.39, 568, 569, 570

[56] References Cited

U.S. PATENT DOCUMENTS

| | | | |
|---|---|---|---|
| 3,444,846 | 4/1967 | Sarto et al. | 123/568 |
| 3,580,232 | 5/1971 | Sarto | 123/568 |
| 3,587,541 | 6/1971 | Sarto | 123/568 |
| 3,646,923 | 4/1972 | Sarto | 123/568 |
| 3,717,131 | 2/1973 | Chana et al. | 123/568 |
| 3,756,210 | 9/1973 | Kuehl | 123/568 |
| 3,915,128 | 10/1975 | Rich | 123/184.32 |
| 3,918,424 | 11/1975 | Anderson et al. | 123/547 |
| 4,072,133 | 2/1978 | McWhirter | 123/568 |
| 4,094,283 | 6/1978 | Sutton | 123/568 |
| 4,150,649 | 4/1979 | Gropp | 123/568 |
| 4,258,687 | 3/1981 | Mauch et al. | 123/570 |
| 4,276,865 | 7/1981 | Hamai | 123/568 |
| 4,328,781 | 5/1982 | Morita | 123/570 |
| 4,342,300 | 8/1982 | Matthes | 123/430 |
| 4,354,463 | 10/1982 | Otani et al. | 123/308 |
| 4,367,719 | 1/1983 | Kimura et al. | 123/568 |
| 4,453,502 | 6/1984 | Resler, Jr. | 123/1 R |
| 4,492,209 | 1/1985 | Otani et al. | 123/568 |
| 4,513,698 | 4/1985 | Senga et al. | 123/432 |
| 4,615,324 | 10/1986 | Choushi et al. | 123/568 |
| 4,693,226 | 9/1987 | Choma | 123/568 |
| 4,732,118 | 3/1988 | Tanahashi et al. | 123/65 VD |
| 4,829,958 | 5/1989 | Duret | 123/316 |
| 4,854,291 | 8/1989 | Elsbett et al. | 123/569 |
| 4,875,455 | 10/1989 | Hashimoto et al. | 123/568 |
| 4,924,840 | 5/1990 | Wade | 123/571 |
| 5,003,933 | 4/1991 | Rush, II et al. | 123/568 |
| 5,014,654 | 5/1991 | Ishibashi | 123/568 |
| 5,307,784 | 5/1994 | Choma et al. | 123/568 |

FOREIGN PATENT DOCUMENTS

| | | |
|---|---|---|
| 63-239354 | 10/1988 | Japan . |
| 1380600 | 1/1975 | United Kingdom . |

OTHER PUBLICATIONS

SAE Technical Paper Series 850133 "The Effect of EGR System Response Time on $NO_x$ Feedgas Emissions During Engine Transients" Throop et al, Feb. 25–Mar, 1, 1985.

SAE Technical Paper Series 810010 "Nissan NAPS–Z Engine Realizes Better Fuel Economy and Low $NO_x$ Emission" Harada et al, Harada et al, Feb. 23–27, 1981.

SAE Technical Paper Series 841256 "A Comparison Between Predicted and Measured Feedgas Emissions for Dynamic Engine Operation", Oct. 1–4, 1984, Hamburg et al.

Proceedings of the American Control Conference, Jan. 19–21–1985—FA9—10:15 "Dynamic Control of Engine $NO_x$ Emissions: Characterization and Improvement of the Transient Response of an Exhaust Gas Recirculation System" M. J. Troop et al.

*Primary Examiner*—Willis R. Wolfe

*Attorney, Agent, or Firm*—Jerome R. Drouillard; Roger L. May

[57] ABSTRACT

An intake manifold for a multicylinder internal combustion engine includes intake runners for conducting air or air and fuel to intake ports formed in the engine cylinder head and an EGR passage formed in the manifold and extending generally parallel to the crankshaft of the engine. Secondary EGR passages extend from the EGR supply passage to intake runners or intake ports, and a coolant passage formed in the manifold extends generally parallel to the EGR supply passage and has a common wall with the EGR passage.

15 Claims, 3 Drawing Sheets

INTERNAL COMBUSTION ENGINE INTAKE MANIFOLD WITH INTEGRAL EGR COOLER AND PORTED EGR FLOW PASSAGES

BACKGROUND OF THE INVENTION

The present invention relates to an intake manifold for a multicylinder internal combustion engine in which exhaust gas recirculation (EGR) is introduced by means of a central distribution system into runners of the intake manifold in close proximity to the intake valves.

DISCLOSURE INFORMATION

EGR is essential to the control of emissions of oxides of nitrogen ($NO_x$) by modern automotive internal combustion engines. EGR systems have been used in automotive engines for more than 25 years. During this time, most EGR systems have utilized a central EGR valve which admits exhaust gas into the incoming air or air/fuel mixture at a point in the intake manifold plenum which is well upstream of the intake ports located in the cylinder heads. As a result, it is not possible to finely or precisely control EGR flow because of the inherent time lags involved in stopping and starting the flow. This may cause control problems. For example, it is desirable to avoid misfire during closed throttle deceleration, inasmuch as misfire produces high levels of unburned hydrocarbon in the exhaust. Because combustion instability and misfire is promoted if the level of EGR in the cylinder is too great during deceleration, it is often not possible to operate an engine with a level of EGR which would otherwise be desirable for $NO_x$ control because it is not possible to shut off the EGR and purge the intake manifold of EGR gases before the throttle is closed. As a result, $NO_x$ control suffers because the engine must be operated with a lower overall level of EGR. Although various schemes have been tried to introduce EGR at points other than at a spacer mounted under a throttle body or at a central point in the engine's induction system, other problems have arisen. For example, EGR gases have been introduced in a spacer located between an intake manifold and a cylinder head, at the mounting surface between the cylinder head and manifold. This has resulted in sludging in some engines and has generally been unsatisfactory. In contrast, the present system uses an axially extending, cooled, central EGR distribution system having special anti-sludging features which promote the rapid control of EGR flow without the plugging associated with other systems. It is thus an advantage of the present system that higher levels of EGR may be used in an engine without concomitant problems such as misfire and sludging of the EGR passages and discharge nozzles. And, sludging of secondary throttles is avoided because EGR is routed exclusively through the manifold's primary runners.

SUMMARY OF THE INVENTION

An intake manifold for a multicylinder reciprocating internal combustion engine with a cylinder block having at least one cylinder head mounted thereto and a crankshaft mounted therein, has a plurality of intake runners conducting air and sometimes air and fuel to a plurality of intake ports formed in the cylinder head, and an EGR supply passage formed in the manifold and extending generally parallel to the crankshaft of the engine. A plurality of secondary EGR passages is contained in the intake manifold, with the secondary EGR passages extending from the EGR supply passage to the intake runners. A coolant passage formed in the manifold extends generally parallel to the EGR supply passage and has a common wall with the EGR supply passage. Each of the secondary EGR passages comprises a cylindrical aperture having an orifice cartridge inserted therein, with each cartridge comprising a generally cylindrical hollow body having a sharp edged orifice contained in one end thereof. The end of each orifice cartridge having the sharp edged orifice protrudes into one of the intake runners for a length which exceeds one fourth of the diameter of the cylindrical hollow body of the cartridge.

In one embodiment of the present invention, the cylinder head has a separate exhaust port associated with each of the cylinders, with the EGR supply passage being furnished with exhaust gas from at least two of the exhaust ports, and with a separate exhaust feeder passage extending from each of the exhaust ports to the EGR supply passage. In a preferred embodiment, a manifold according to the present invention is mounted between the cylinder banks of a V-type engine with the EGR supply passage and coolant passage being situated approximately an equal distance from each of the cylinder banks. The coolant passage has an engine coolant path flowing through it such that the engine coolant will remove heat from exhaust gas flowing through the EGR supply passage.

In a preferred embodiment, each of the secondary EGR discharge passages comprises a cylindrical aperture having an orifice cartridge inserted therein, with said cartridges each comprising a generally cylindrical body having a sharp edged orifice contained in one end thereof and being retained in an intake manifold by means of a plurality of extension tabs extending axially and radially from the end of the cylindrical body which opposes the end having the sharp edged orifice.

According to yet another aspect of the present invention, the subject intake manifold is ideally applied to an engine having primary and secondary intake runners for conducting air and fuel (or only air, in the case of diesel, or direct-injection or port injected gasoline engines) to the intake ports of the engine, with flow through the ports being controlled by either a single intake valve for each of the engine's cylinders or a plurality of intake valves for each of the cylinders.

EGR flow according to the present invention is considered to be ported because EGR gases flow through secondary EGR passages extending from an EGR supply passage to the individual runners of the intake manifold. Moreover, those skilled in the art will appreciate in view of this disclosure that a system according to the present invention could be employed so as to conduct EGR into the intake ports within the cylinder heads, as opposed to EGR entry into the intake manifold runners. In such case, the secondary EGR passages could extend from the intake manifold into the cylinder head's intake ports without passing through the runners upstream of the intake ports.

DETAILED DESCRIPTION OF THE PREFERRED EMBODIMENTS

Figure 1:
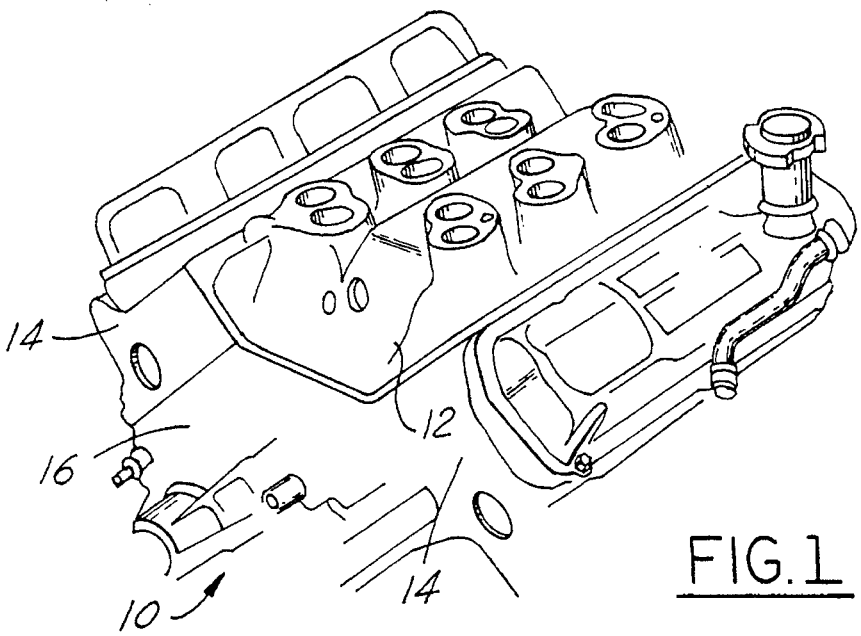
FIG. 1 is a perspective view of a V-type engine having an intake manifold according to the present invention. Those skilled in the art will appreciate in view of this disclosure that only the lower part of the intake manifold is shown, it being understood that an upper part having at least a throttle body, if not fuel injectors associated therewith would be applied to the engine in a fashion known to those skilled in the art and suggested by this disclosure.

As shown in FIG. 1, engine 10 has lower intake manifold 12 and cylinder heads 14. Although engine 10 is shown as being of the V-type, those skilled in the art will appreciate in view of this disclosure that an intake manifold according to the present invention could be applied to an engine having an inline, or horizontally opposed, or other type of configuration. Moreover, the present invention could be applied to an engine having a single or divided intake ports controlled by one valve or divided intake ports controlled by more than one intake valve.

Figure 2:
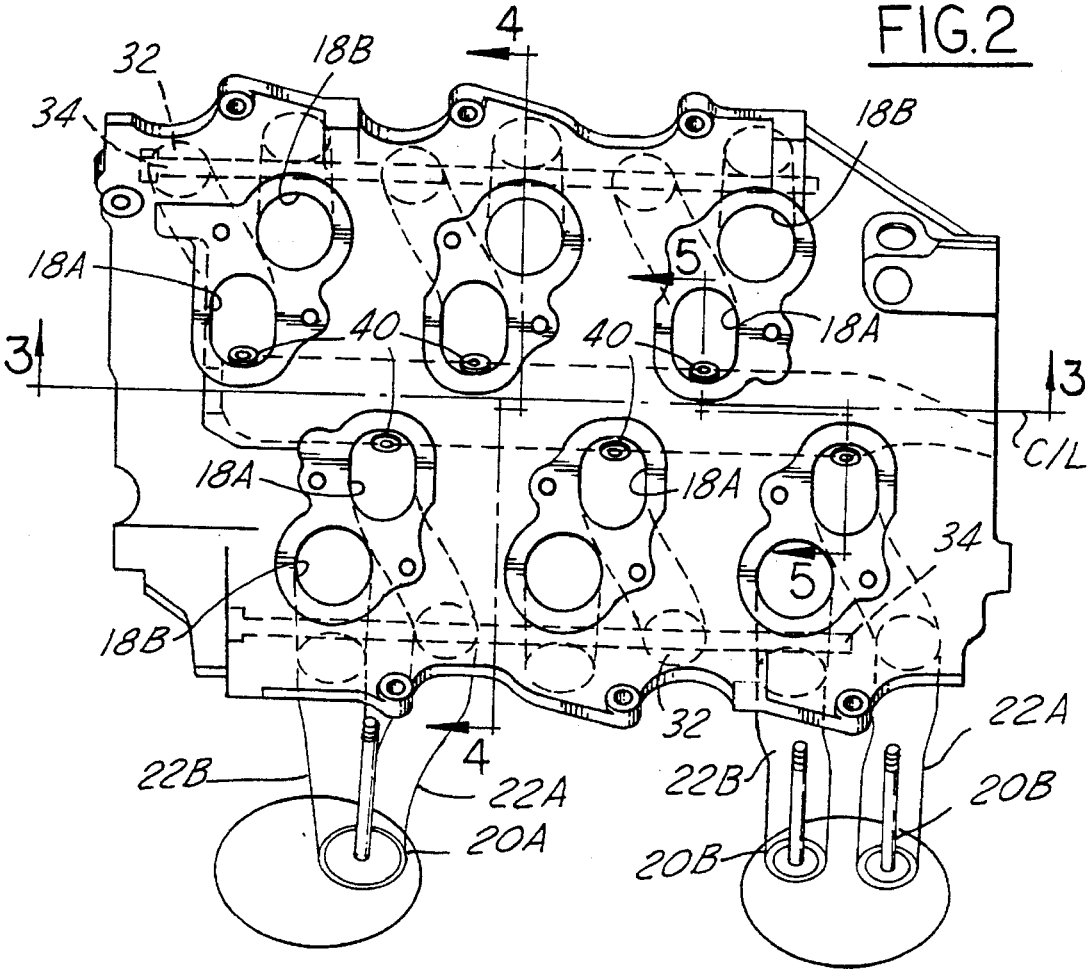
FIG. 2 is a plan view of an intake manifold according to the present invention.

As shown in FIG. 2, intake manifold 12 according to the present invention has a series of primary intake runners 18A which are open at all times, and a plurality of secondary intake runners 18B, the flow through which is controlled by a series of secondary port throttles 2, which are mounted on common shafts 34. EGR is introduced only through primary intake runners 18A because in this manner the flow through primary runners 18A will generate high swirl and fast burn combustion characteristics. This will allow an engine equipped with a system according to the present invention to maintain acceptable combustion characteristics with high quantities of EGR gas, allowing improvements in fuel economy and reduced $NO_x$ emissions, and, because EGR is introduced close to the intake ports (22, FIG. 9) within the cylinder heads, the engine will tolerate increased quantities of EGR as a result of the quick response of the system. Introduction of EGR through primary runners 18A also allows the use of EGR when secondary port throttles 32 are closed.

FIG. 2 illustrates that a system according to the present invention may be applied to an engine having a single intake valve 20 serving two intake ports, 22A and 22B controlled by single valve 20A in one case, or by two intake ports 22A and 22B controlled by two valves 20B. In either case, EGR is introduced into the engine via primary intake runners 18A, so as to achieve high velocity flow and resulting high swirl and fast burn characteristics. Those skilled in the art will appreciate in view of this disclosure that more than two intake valves could be employed according to the present invention.

Figure 3:
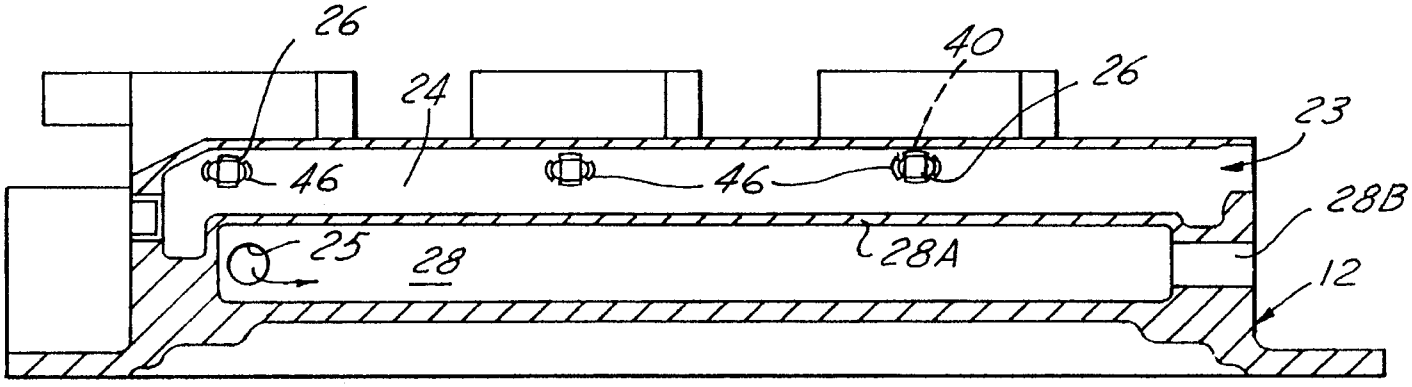
FIG. 3 is a longitudinal cross-section of a manifold according to the present invention, taken along the line 3—3 of FIG. 2, which is also the centerline of the engine's crankshaft, which is marked C/L.
Figure 6:
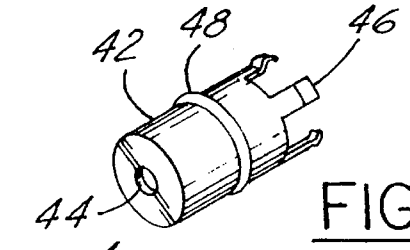
FIGS. 6 and 7 are perspective views of an orifice cartridge according to one aspect of the present invention.
Figure 4:
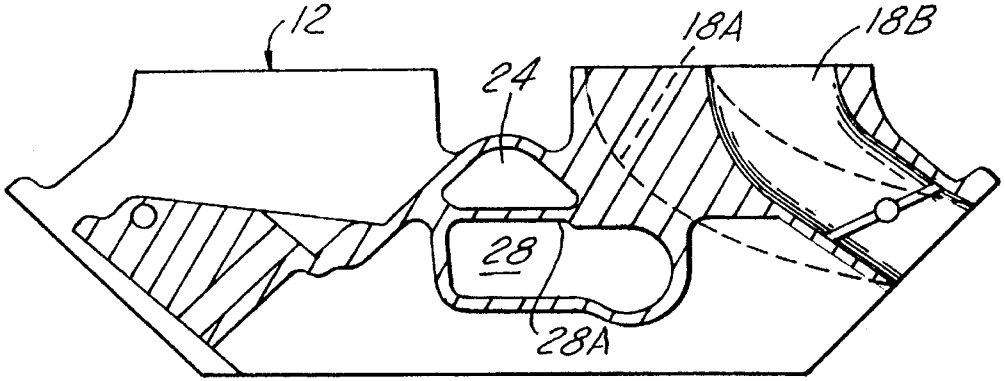
FIG. 4 is a transverse cross-section of a manifold of FIG. 2 taken along the line 4—4 of FIG. 2.

FIGS. 3 and 4 illustrate the construction of the EGR supply passage and coolant passages in a manifold according to the present invention. As best seen in FIG. 4, EGR supply passage 24 is formed in and integral with manifold 12. As suggested in FIG. 3, supply passage 24 extends generally parallel to the crankshaft of the engine. The centerline of the crankshaft is shown in FIG. 2 as C/L; the outline of EGR supply passage 24 is shown in ghost in FIG. 2, which of course is a plan view of manifold 12. As shown in FIGS. 3 and 4, engine coolant passage 28 shares a common wall, 28A, with EGR supply passage 24. As with EGR supply passage 24, coolant passage 28 is cored into manifold 12, which may be formed from aluminum or other metallic or non-metallic, heat-resistant and low heat transmitting materials known to those skilled in the art and suggested by this disclosure. Because coolant passage 8 has a common wall with EGR supply passage 24, this shared common wall allows heat transfer between EGR gases and engine coolant. As a result, during cold operation, hot coolant warms EGR supply passage 24, so as to reduce the risk of condensation and sludging or deposit obstruction of sharp edged orifices 44 (FIG. 6). During warmed-up or hot engine operation, the relatively cold coolant extracts heat from the EGR gases, reducing the risk of detonation and also reducing the risk of deposit formation within the various EGR passages. An additional advantage of the present system is that because the hot exhaust gas is confined solely to the lower manifold, manifold 12 in this case, the upper manifold (not shown) may be constructed of lighter and less costly thermoplastic because the upper manifold need not come in contact with the hot, corrosive EGR gases.

FIG. 3 illustrates water passage 25 allowing engine coolant to pass into coolant passage 28. After flowing the length of passage 28, coolant exits through outlet 28B.

Figure 7:
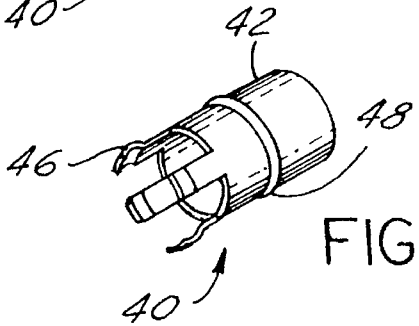
Figure 5:
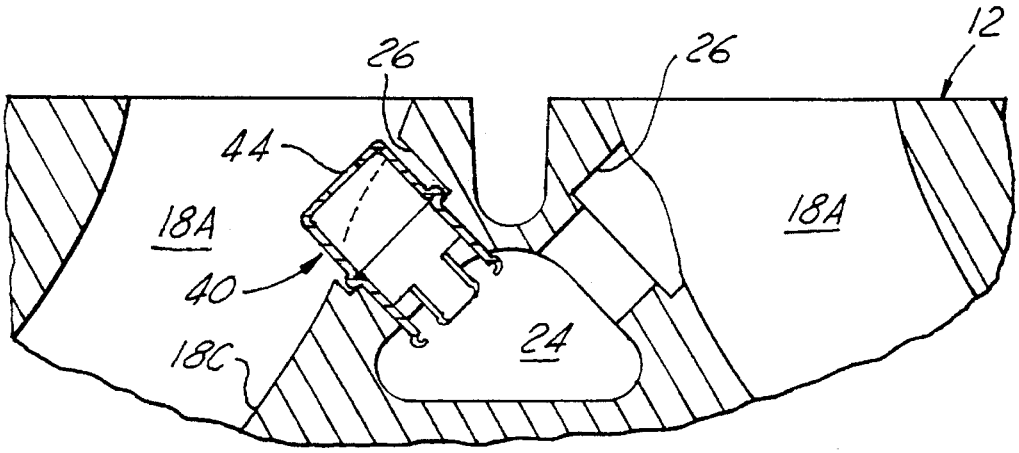
FIG. 5 is a sectional view of a manifold of the present invention taken along the line of 5—5 of FIG. 2, showing an orifice cartridge with particularity.

Details of construction of the secondary EGR passages and orifice cartridges are shown in FIGS. 5, 6, and 7. Starting with cylindrical aperture 26, which extends from EGR supply passage 24 to primary intake runner 18A, the secondary EGR passages each further include orifice cartridge 40 having a generally cylindrical hollow body 42, with a first end having sharp edged orifice 44 therein, and a second end having a plurality of retention tabs 46 extending axially and radially from the end of generally cylindrical body 42. It has been determined that stainless steel comprises an appropriate material for construction of orifice cartridges 40. It has further been determined that it is beneficial for cartridges 40 to extend, as shown in FIG. 5, a distance from the wall of runner 18A through which the cartridge extends. In other words, the sharp edged orifice 44 should be carried at some distance from wall 18C through which the orifice cartridge extends. Extension of sharp edged orifice 44 into runner 18A by a distance exceeding one fourth of the diameter of cylindrical hollow body 42 will assure that flow through orifice 44 is not occluded due to a build-up of sludge in and around orifice 44. Although not wishing to be bound by the theory, it is believed that protrusion of sharp edged orifice 44 into runner 18A causes a reduction in the risk of plugging because of convective cooling from the passing air stream. FIGS. 6 and 7 show collar 48 comprising an annular radial extension of the outer cylindrical surface of generally hollow body 42. Collar 48 allows orifice cartridge 40 to be inserted either manually or by automated machinery to a preset protrusion level, so as to maintain the beneficial protrusion of orifice 44 into runner 18A. Those skilled in the art will appreciate in view of this disclosure that orifice cartridges 40 could be retained within their parent bores by alternate means such as staking, pressing, welding, bonding, or other means.

Figure 9:
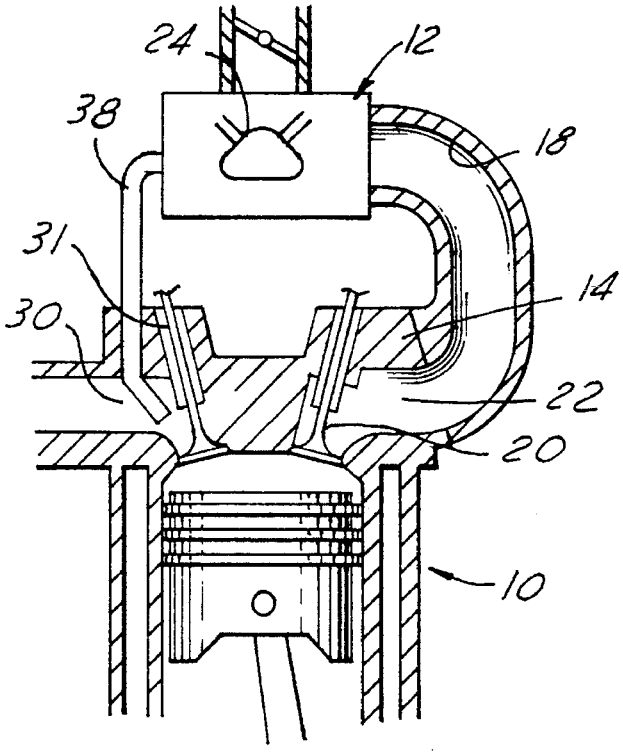
FIG. 9 is a schematic representation of an alternative embodiment of the present invention.

FIG. 9 illustrates yet another aspect of the present invention, which schematically indicates that EGR supply passage 24 is furnished with exhaust gas taken directly from exhaust ports 30 of the engine, with a separate exhaust feeder passage 38 extending from each of exhaust ports 30 at a location which is adjacent exhaust valve 31 and its seat, to EGR supply passage 24. Each exhaust feeder passage 38 has one end which is located adjacent the exhaust valve and seat. It has been determined that drawing exhaust gases from the individual exhaust ports close to the exhaust valve and seat will allow the recirculation of exhaust gases containing high levels of unburned hydrocarbons and, as a result, the unburned hydrocarbon emissions of the engine will be correspondingly reduced. This effect is even more pronounced during cold engine warmup, given the fact that most catalysts are not operational during cold starting and warmup, and any reduction of unburned hydrocarbons is particularly needed.

Figure 8:
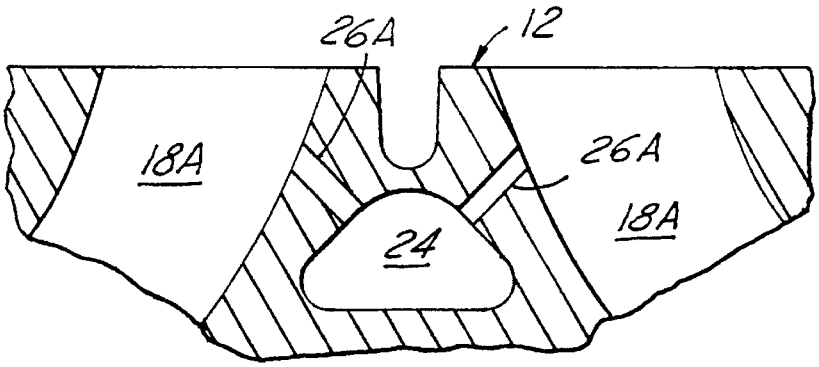
FIG. 8 shows an alternative embodiment according to the present invention.

FIG. 8 illustrates an alternate embodiment of the present invention in which the secondary EGR passages comprise bare cylindrical borings 26A. In certain applications an ordinary drilling as shown in FIG. 8 may produce satisfactory results in terms of resisting plugging, and if this is the case, the cost of a system according to the present invention may be correspondingly reduced by eliminating the need for a plurality of orifice cartridges 40.

While the invention has been shown and described in its preferred embodiments, it will be clear to those skilled in the arts to which it pertains that many changes and modifications may be made thereto without departing from the scope of the invention. For example, although the intake runners are generally described herein as conveying air and fuel to the intake ports of the cylinder heads, the present invention is equally applicable to fuel injection arrangements in which only air is carried through the intake runners, with the fuel being supplied either through direct cylinder fuel injection as with diesel or direct-injected gasoline engines, or by means of port injection of gasoline. Also, the present invention could be applied to natural gas fueled engines, or other types of internal combustion engines.

We claim:

1. An intake manifold for a multicylinder, v-type reciprocating internal combustion engine having a cylinder block with two cylinder heads mounted thereto and a crankshaft mounted therein, with said manifold comprising:

a plurality of intake runners for conducting air and fuel to a plurality of intake ports formed in the cylinder heads;

an EGR supply passage formed in said manifold and extending generally parallel to the crankshaft of the engine, with said passage being located between said cylinder heads;

a plurality of secondary EGR passages, with at least one of said secondary passages extending generally laterally from said EGR supply passage to at least one of said intake runners; and an engine coolant passage formed in said manifold, with said engine coolant passage extending generally parallel to the EGR supply passage and having a common wall with said EGR supply passage.

2. An intake manifold according to claim 1, wherein said manifold comprises a casting, with said EGR passage and said engine coolant passage being cored in said casting.

3. An intake manifold for a multicylinder reciprocating internal combustion engine having a cylinder block with at least one cylinder head mounted thereto and a crankshaft mounted therein, with said manifold comprising a unitary body having:

a plurality of intake runners for conducting air to a plurality of intake ports formed in the cylinder head;

4. An intake manifold according to claim 3, wherein each of said secondary EGR passages comprises a cylindrical aperture having an orifice cartridge inserted therein, with said cartridges each comprising a generally cylindrical body having a sharp-edged orifice contained in one end thereof.

5. An intake manifold according to claim 3, wherein each of said cartridges further comprises a plurality of retention tabs extending axially and radially from the end of said generally cylindrical body which opposes the end having said sharp-edged orifice.

6. A multicylinder reciprocating internal combustion engine having a cylinder block with at least one cylinder head mounted thereto and a crankshaft mounted therein, and an intake manifold, with said manifold comprising:

a plurality of primary intake runners for conducting air to a first plurality of intake ports formed in the cylinder head;

a plurality of secondary intake runners for conducting air and fuel to a second plurality of intake ports formed in the cylinder head;

an EGR supply passage formed in said manifold and extending generally parallel to the crankshaft of the engine;

a plurality of secondary EGR passages, with one of said secondary passages extending from said EGR supply passage to each of said primary intake runners; and a coolant passage formed in said manifold and extending generally parallel to the EGR supply passage and having a common wall with said EGR supply passage.

7. An engine according to claim 6, wherein the flow through said first plurality of intake ports and said second plurality of intake ports is controlled by a single intake valve for each of said cylinders.

8. An engine according to claim 6, wherein the flow through said first plurality of intake ports and said second plurality of intake ports is controlled by a plurality of intake valves for each of said cylinders.

9. An intake manifold for a multicylinder reciprocating internal combustion engine having a cylinder block with at least one cylinder head mounted thereto and a crankshaft mounted therein, with said manifold comprising:

a plurality of intake runners for conducting air and fuel to a plurality of intake ports formed in the cylinder head;

an EGR supply passage formed in said manifold and extending generally parallel to the crankshaft of the engine;

a plurality of secondary EGR passages, with said secondary passages extending from said EGR supply passage to said intake runners; and a coolant passage formed in said manifold and extending generally parallel to the EGR supply passage and having a common wall with said EGR supply passage.

10. An intake manifold according to claim 9, wherein said manifold is mounted between the cylinder banks of a v-type engine, with said EGR supply passage and said coolant passage situated approximately equidistant from each of the cylinder banks.

an EGR supply passage formed in said manifold and extending generally parallel to the crankshaft of the engine;

a plurality of secondary EGR passages, with at least one of said secondary passages extending laterally from said EGR supply passage to at one of said intake runners; and a coolant passage formed in said manifold and extending generally parallel to the EGR supply passage and having a common wall with said EGR supply passage, such that engine coolant flowing through said coolant passage will remove heat from exhaust gas flowing through said EGR supply passage.

11. An intake manifold according to claim 9, wherein said cylinder head has a separate exhaust port associated with each of said cylinders and said EGR supply passage is furnished with exhaust gas from at least two of said exhaust ports, with a separate exhaust feeder passage extending from each of said at least two exhaust ports to said EGR supply passage, and with each of said exhaust feeder passages having one end located adjacent to the exhaust valve and seat within one exhaust port.

12. An intake manifold according to claim 11, wherein said EGR supply passage is furnished with exhaust gas from all of said exhaust ports by means of an individual exhaust feeder passage for each cylinder.

13. An intake manifold according to claim 9, wherein each of said secondary EGR passages comprises a cylindrical aperture having an orifice cartridge inserted therein, with said cartridge comprising a generally cylindrical hollow body having a sharp-edged orifice contained in one end thereof.

14. An intake manifold according to claim 13, wherein the end of each orifice cartridge containing said sharp-edged orifice protrudes into one of said intake runners for a length which exceeds one-fourth of the diameter of said cylindrical hollow body.

15. An intake manifold according to claim 14, wherein each orifice cartridge has an annular collar extending radially from the outer surface of said generally hollow body and defining the desired installed position of said cartridge, so as to predetermine the extent to which the cartridge protrudes into said intake runner.

* * * * *